United States Patent [19]

Rochlitz

[11] 3,989,520

[45] Nov. 2, 1976

[54] ELECTROPHOTOGRAPHIC DUAL LAYER RECORDING MATERIAL

[75] Inventor: Jürgen Rochlitz, Breckenheim, Germany

[73] Assignee: Hoechst Aktiengesellschaft, Germany

[22] Filed: May 20, 1975

[21] Appl. No.: 579,178

Related U.S. Application Data

[63] Continuation of Ser. No. 354,204, April 25, 1973, abandoned.

[30] Foreign Application Priority Data

Sept. 21, 1972 Germany ..... 2246255

[52] U.S. Cl. ..... 96/1.5; 96/1.6

[51] Int. Cl.[2] ..... G03G 5/06

[58] Field of Search ..... 96/1 R, 1 PE, 1.3, 1.5, 96/1.6; 252/501

[56] References Cited

UNITED STATES PATENTS

| | | | |
|---|---|---|---|
| 3,287,123 | 11/1966 | Hoegl | 96/1.5 |
| 3,598,582 | 8/1971 | Herrick et al. | 96/1.5 |
| 3,837,851 | 9/1974 | Shattuck et al. | 96/1.5 |
| 3,877,935 | 4/1975 | Regensburger et al. | 96/1.5 |

FOREIGN PATENTS OR APPLICATIONS

| | | | |
|---|---|---|---|
| 562,336 | 5/1958 | Belgium | 96/1.5 |
| 2,028,319 | 12/1970 | Germany | 96/1.5 |
| 883,790 | 12/1961 | United Kingdom | 96/1.5 |

OTHER PUBLICATIONS

Chadwell et al., "Photoconductor", IBM Tech. Discl. Bull., vol. 14, No. 9, Feb. 1972, p. 2781.

*Primary Examiner*—Roland E. Martin, Jr.
*Attorney, Agent, or Firm*—James E. Bryan

[57] ABSTRACT

This invention relates to an electrophotographic recording material consisting of an electroconductive support material and a photoconductive double layer of organic materials which consists of a homogeneous, opaque, charge carrier producing dyestuff layer and of a transparent top layer of insulating materials with at least one charge transporting compound.

13 Claims, 31 Drawing Figures

FORMULAE

FORMULAE

FORMULAE

FORMULAE

FORMULAE

FORMULAE

FORMULAE

FORMULAE

ELECTROPHOTOGRAPHIC DUAL LAYER RECORDING MATERIAL

Figure 1:
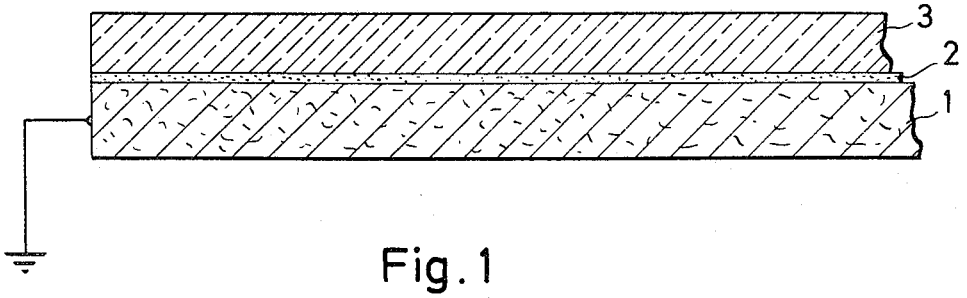

This is a continuation of application Ser. No. 354,204, filed Apr. 25, 1973, now abandoned.

This invention relates to an electrophotographic recording material consisting of an electroconductive support material and a photoconductive double layer of organic materials which consists of a homogeneous, opaque, charge carrier producing dyestuff layer and of a transparent top layer of insulating materials with at least one charge transporting compound.

It is known from German Offenlegungsschriften Nos. 1,597,877 and 1,797,342 for electrophotographic recording material to extend the spectral sensitivity of selenium layers to the red spectral range by a double layer arrangement, e.g. with phthalocyanine dispersion layers, Disadvantageous are the vacuum vapour depositions of selenium requiring high technicaal expenditure, the brittleness of comparatively thick selenium layers, the poor adhesion of adjacent heterogeneous constituents in these layers and the only difficulty realizable uniformly wetting coating with the corresponding dispersions. Furthermore, no optimum light-sensitivities can be achieved as a result of the absorption behaviour and the different charge conducting mechanisms of selenium and phthalocyanine in the double layer arrangement. From U.S. Pat. No. 3,573,906, for example, there are also known photoconductive double layers containing an organic, possibly photoconductive, insulating layer between the support material and the vapor-deposited selenium layer in order to impart adhesion. Such a layer construction, however, considerably hinders the necessary charge transport so that, in this case too, no higher light-sensitivities are obtainable, light-sensitivities are obtainable.

Furthermore, from German Auslegeschrift No. 1,964,817, it is known to provide vapor-deposited selenium layers with a layer of an organic, photoconductive insulating material which is substantially insensitive to light in the visible range of the spectrum. According to German Offenlegungsschrift No. 2,120,912, it has also been suggested to use those light-sensitive layer arrangements for electrophotographic recording materials which contain, as the charge carrier producing layer, an inorganic material, such as the sulfide, selenide, sulfoselenide or telluride of cadmium or zinc, and as the charge carrier transporting layer, an organic material with at least 20 per cent by weight of 2,4,7-trinitro-9-fluorenone. A disadvantage of the production of these layers with inorganic photoconductors is the exact observation of the vapor deposition conditions of selenium or the exact adjustment of the mixtures in order to obtain a good photoconductive modification of the inorganic materials. Furthermore, the adhesion of selenium to conductive support material, such as to aluminium, is insufficient. Fatigue in repeated charge/exposure cycles does not allow the use in electrophotographic copying devices.

Japanese patent application No. 43-26710 already discloses photoconductive double layers of organic materials on a conductive support. According to that application, a lower, relatively thick layer of a considerably diluted homogeneous solution of a sensitizer in a binder is provided with an upper transparent light-sensitive layer. This layer construction, however, only offers a relatively low senstivity increase only little meeting technical demands. Another known suggestion according to German Offenlegungsschrift No. 1,909,742 is repeatedly pour a sensitizer solution over a photoconductive layer and to evaporate the solvent. A disadvantage thereof is the low mechanical resistance of the applied layer as a result of insufficient cohesion and adhesion of the applied sensitizer. Furthermore, repeated coating is cumbersome.

The construction of photoconductive double layers containing a dyestuff layer is also known, e.g. from Belgian Pat. Nos. 763,389 and 763,541, but for this layer construction, top layers are used which allow no sensitivities satisfying highest demands and, as regards adhesion between the dyestuff layer and the top layer, do not represent an optimization and are not sufficiently resistant to mechanical attack, e.g. in electrophotographic copying devices, particularly to that due to the cleaning of the photoconductive layer.

It is the object of the present invention to provide an organic photoconductor layer highly light-sensitive for the xerographic copying procedure which overcomes the described disadvantages and the adhesion of which between the various layers satisfies the highest technical demands, which exhibits no wear or fatigue and which, even after repeated use, may be used again rapidly.

The present invention provides an electrophotographic recording material consisting of an electroconductive support material with a photoconductive double layer of organic materials which consists of a homogeneous, opaque, charge carrier producing dyestuff layer and of a transparent top layer of insulating materials with at least one charge transporting compound and is characterized in that the organic dyestuff layer consists of a compound of the general formula

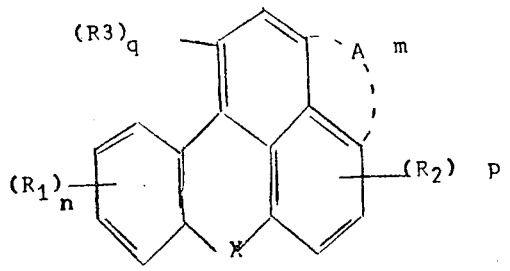

(I)

or

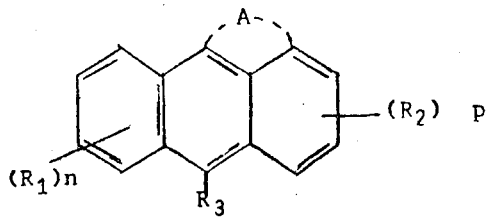

(II)

in which

X is —O—, —S— or —CO— and

A is —CO—B—CO—, with

B being —O— or —NR—, in which

R is hydrogen, $C_1$–$C_4$ -alkyl, $C_3$–$C_8$ -alkoxyalkyl, optionally substituted aryl or an N-heterocyclic radical, and $R_1$, $R_2$, and $R_3$ are identical or different and stand for hydrogen, $C_1$–$C_4$ -alkyl, $C_1$–$C_4$ -alkoxy, amino or nitro groups or halogen and, in the case of Formula I, $R_3$ may also stand for a fused benzene ring, and in which $m$ is 0 or 1 and $n$, $p$, and $q$ are an integer between 1 and 4 and $n + p + q \leq 10$, and in that the transparent top layer consists of a mixture of a charge transporting, carbocyclic or heterocyclic compound with at least one substituted amino group and having an extended $\pi$-electron system or of a condensation product from 3-bromopyrene and formaldehyde and of a binder.

By means of the invention, it is possible to obtain highly light-sensitive, photoconductive double layers for the electrophotographic recording material of the invention which have a high mechanical resistance and may be arranged on a cylindrical drum, for example, or may circulate as an endless belt without exhibiting special signs of wear and thus are very suitable for use in electrophotographic copying devices. The high light-sensitivity particularly results from the fact that the charge transporting compound present in the transparent top layer is sensitized by the charge carrier producing dyestuff layer in that the charge carriers, such as electrons or holes are taken by the top layer.

In a preferred embodiment, the organic dyestuff layer has a thickness in the range from about 0.005 to about 2 $\mu$m, preferably from about 0.01 to about 2 $\mu$m. High concentration of excited dyestuff molecules is achieved thereby in the dyestuff layer and at the bounddary surface between the dyestuff layer and the top layer. Furthermore, the adhesion between the electroconductive support material and the top layer is not impaired.

In a preferred embodiment, the transparent top layer has a thickness in the range from about 5 to about 20 $\mu$m. This assures a sufficiently high charge.

Figure 2:
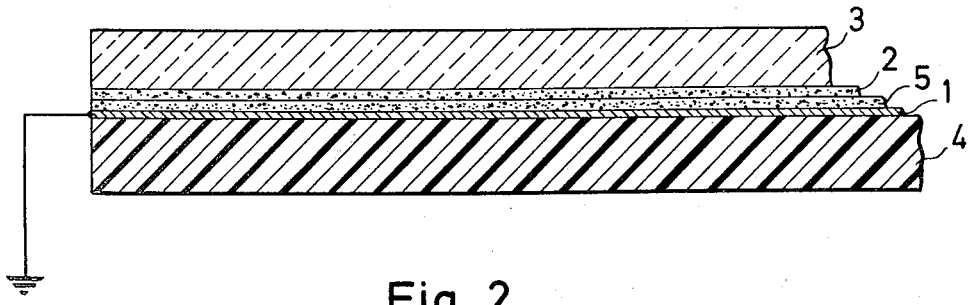

The assembly of the electrophotographic recording material can be seen in the attached FIGS. 1 and 2. FIG. 1 shows a material which consists of an electrocondutive layer support 1, the organic dyestuff layer 2, and the organic transparent top layer 3. FIG. 2 shows a metallized plastic layer 1, 4 as the layer support to which an intermediate layer 5 inhibiting charge carrier injection in the dark may be applied, and the photoconductive double layer from organic dyestuff layer 2 and organic, transparent top layer 3 is on this intermediate layer.

Suitable electroconductive support materials are materials which hitherto have been used for this purpose, for example aluminum foils or transparent plastic support to which aluminum, gold, copper, zinc, cadmium, indium, antimony, bismuth, tin, lead or nickel has been laminated or applied by vapor deposition.

The intermediate layer 5 shown in FIG. 2 consists of organic material, e.g. polyamide resin, or of a thermally, anodically or chemically produced metal oxide layer, e.g. an aluminum oxide layer.

Figure 3:
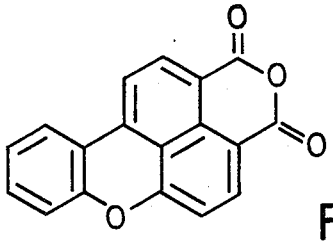

The organic dyestuff layer of the recording material of the invention substantially determines the spectral light-sensitivity of the photoconductive double layer of the invention. According to the general formula, in which possible substituents of the aryl radical are $C_1$–$C_4$-alkyl, especially methyl, $C_1$–$C_4$-alkoxy, especially methoxy, or nitro groups of halogen, especially chlorine, the following dyestuffs listed in the appended Figures are suitable, for example:

FIG. 3 Benzoxanthene-3,4-dicarboxylic acid anhydride

Figure 4:
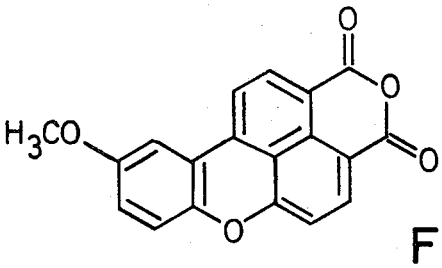
Figure 10:
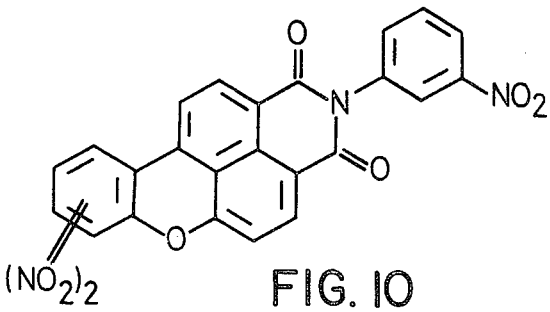

FIG. 4 10-Methoxy-benzoxanthene-3,4-dicarboxylic acid anhydride

Figure 5:
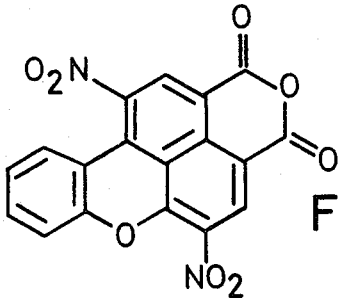

FIG. 5 1,6-Dinitro-benzoxanthene-3,4-dicarboxylic acid anhydride

Figure 6:
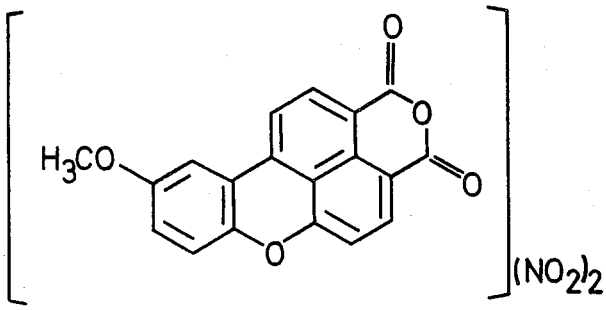

FIG. 6 10-Methoxy-dinitro-benzoxanthene-3,4-dicarboxylic acid anhydride, melting point 273° C (decomposition)

Figure 7:
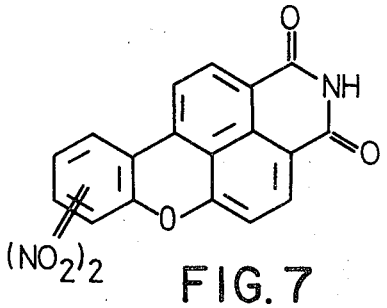
Figure 8:
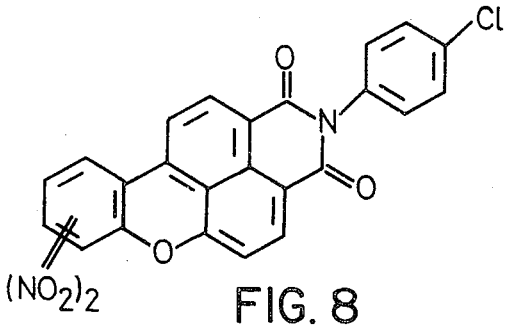
Figure 9:
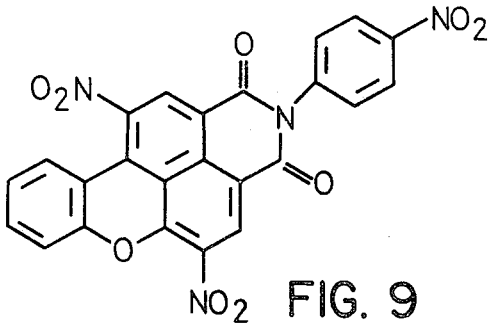
Figure 11:
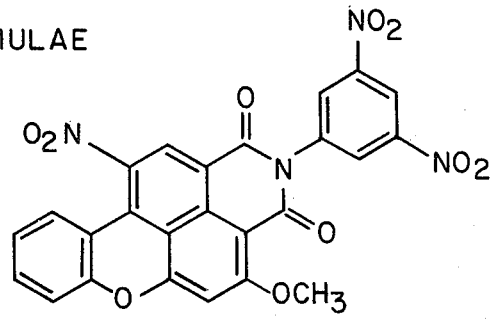
Figure 12:
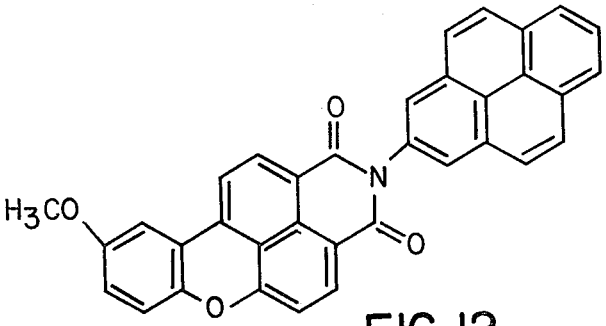
Figure 13:
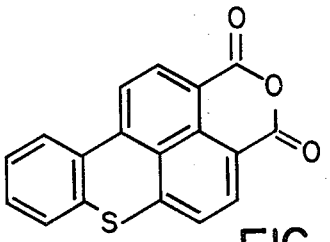
Figure 14:
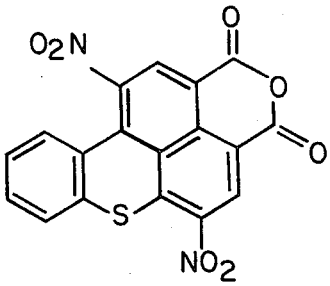
Figure 15:
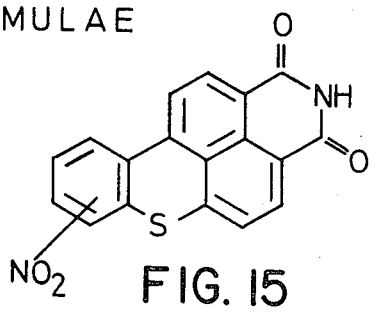
Figure 16:
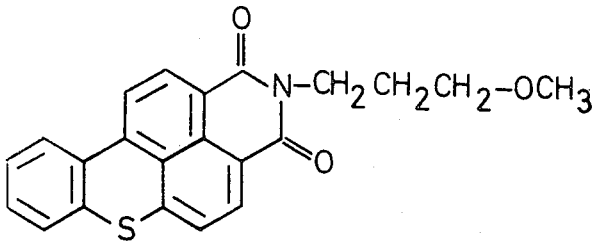
Figure 17:
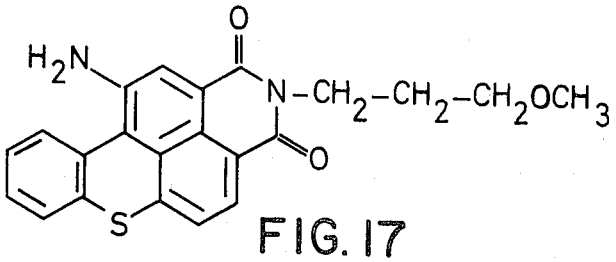
Figure 18:
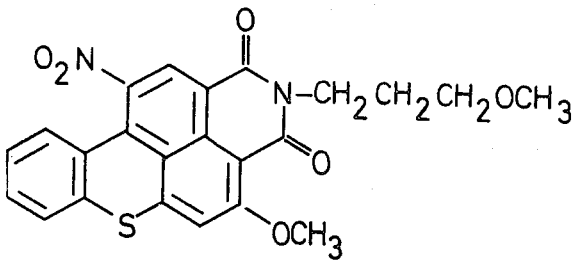
Figure 19:
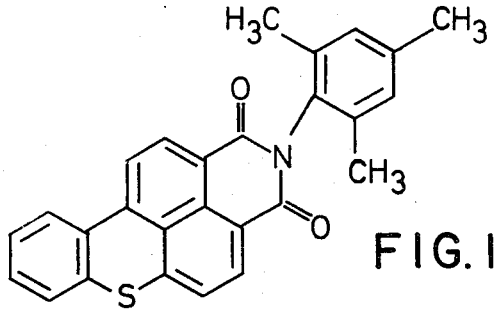
Figure 20:
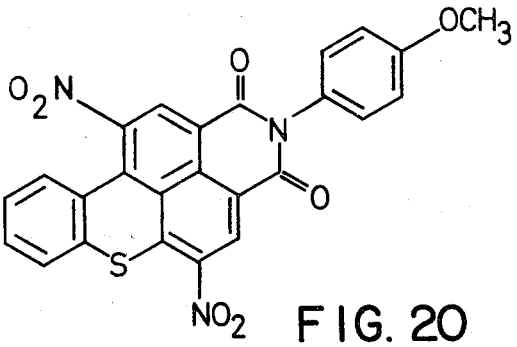
Figure 21:
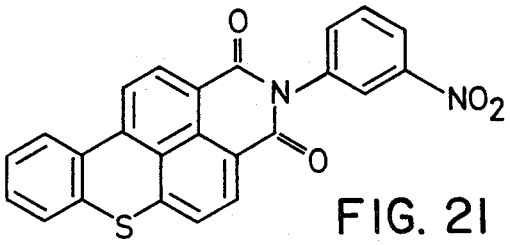
Figure 22:
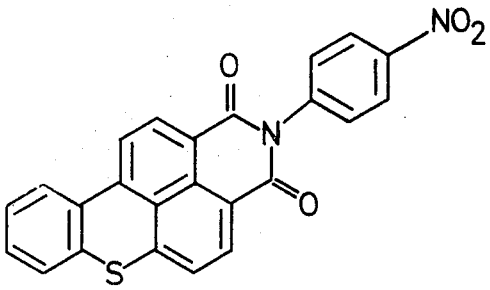
Figure 23:
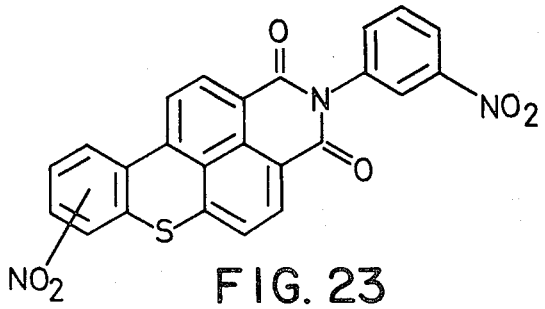

FIG. 7 Dinitro-benzoxanthene-3,4-dicarboxylic acid imide, melting point 373° C FIG. 8 Dinitro-benzoxanthene-3,4-dicarboxylic acid N-(4-chlorophenyl)-imide FIG. 9 1,6-Dinitro-benzoxanthene-3,4-dicarboxylic acid N-(4-nitrophenyl)-imide FIG. 10 Dinitro-benzoxanthene-3,4-dicarboxylic acid N-(3-nitrophenyl)-imide, melting point 340° C FIG. 11 1-Nitro-5-methoxy-benzoxanthene-3,4-dicarboxylic acid N-(3,5-dinitrophenyl)-imide FIG. 12 10-Methoxy-benzoxanthene-3,4-dicarboxylic acid N-(pyrenyl)-imide FIG. 13 Benzothioxanthene-3,4-dicarboxylic acid anhydride FIG. 14 1,6-Dinnitro-benzothioxanthene-3,4-dicarboxylic acid anhydride, melting point 352° C FIG. 15 Mononitro-benzothioxanthene-3,4-dicarboxylic acid imide FIG. 16 Benzothioxanthene-3,4-dicarboxylic acid N-(3-methoxy-n-propyl)-imide FIG. 17 1-Amino-benzothioxanthene-3,4-dicarboxylic acid N-(3-methoxy-n-propyl)-imide FIG. 18 1-Nitro-5-methoxy-benzothioxanthene-3,4-dicarboxylic acid N-(3-methoxy-n-propyl)-imide FIG. 19 Benzothioxanthene-3,4-dicarboxylic acid N-mesityl-imide FIG. 20 1,6-Dinitro-benzothioxanthene-3,4-dicarboxylic acid N-(p-anisyl)-imide FIG. 21 Benzothioxanthene-3,4-Dicarboxylic acid N-(3-nitrophenyl)-imide FIG. 22 Benzothioxanthene-3,4-dicarboxylic acid N-(4-nitrophenyl)-imide, melting point 395° C FIG. 23 Mononitro-benzothioxanthene-3,4-dicarboxylic acid-N-(3-nitrophenyl)-imide, melting point 405° C (decomposition)

Figure 24:
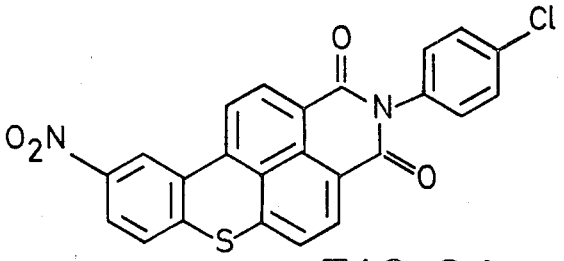

FIG. 24 10-Nitro-benzothioxanthene-3,4-dicarboxylic acid N-(4-chlorophenyl)-imide.

Figure 25:
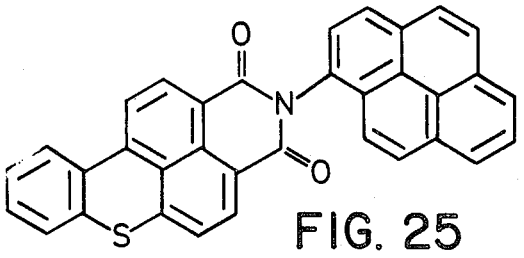

FIG. 25 Benzothioxanthene-3,4-dicarboxylic acid N-(pyrenyl)-imide

Figure 26:
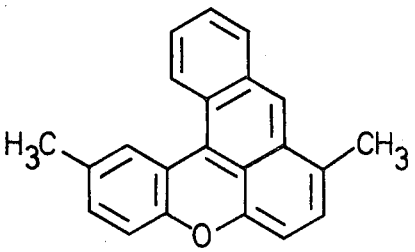

FIG. 26 Fluorol 5 G, C.I. 45,550

Figure 27:
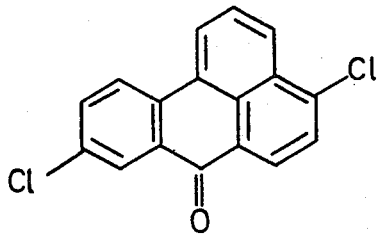

FIG. 27 2,6-Dichlorobenzanthrone (p. 7, II, 472)

Figure 28:
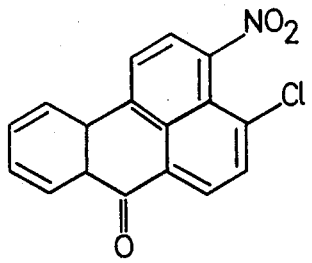

FIG. 28 Bz-1-Nitro-2-chloro-benzanthrone (B. 7. II, 475)

Figure 29:
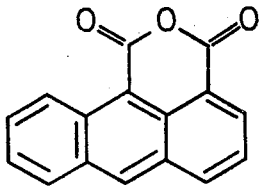

FIG. 29 Anthracene-1,9-dicarboxylic acid anhydride (B. 17, I, 274)

Figure 30:
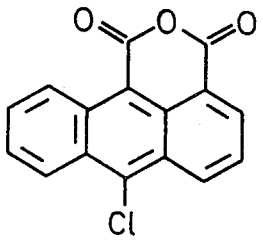
Figure 31:
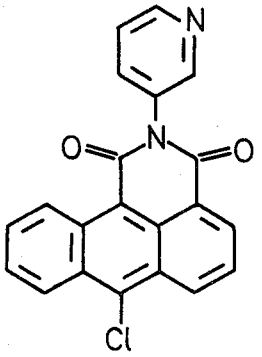

FIG. 30 10-Chloro-anthracene-1,9-dicarboxylic acid-(B. 17, I, 274) anhydride FIG. 31 10-Chloro-anthracene-1,9-dicarboxylic acid-N-($\beta$-pyridyl)-imide Unless otherwise mentioned, the compounds are known from French patent specification No. 1,590,506, German patent specification No. 1,297,259 and German Offenlegungsschrift No. 1,509,701. The compounds mentioned under numbers 5, 7, 8, 9, 10, 14, 15, 20 and 23 were obtained by nitration of the substances mentioned in the publications.

The compound according to FIG. 17 was obtained by hydrogenation of the corresponding nitro compound which in turn was manufactured according to the cited German patent specification No. 1,297,259, followed by nitration.

The preparation of the imides from the compounds of FIGS. 3,4 or 13 was carried out as follows, and is illustrated for the example of the FIG. 12.

The procedure described in Example 4 c of German Offenlegungsschrift No. 1,569,761 was followed, using, instead of 14.4 parts by weight of benzoxanthene-3,4-dicarboxylic acid anhydride, 15.9 parts by weight of the corresponding 10-methoxy-derivative, and instead of 15 parts by weight of 1-amino-2,4-dimethyl-benzene, 54.2 parts by weights of 3-aminopyrene. The reaction time was 12 hours.

The reaction product crystallizes from dimethylformamide in lemon-yellow crystals and has a melting point of above 350° C.

The nitration of the known compounds was carried out as follows, and is described by way of example for the compound according to the FIG. 14: 30.4 parts by weight of the benzothioxanthene-3,4-dicarboxylic acid anhydride obtained according to Example 8 of German patent Specification No. 1,297,259 were suspended in 1,500 parts by weight of ethylene chloride and nitrated at the boil for 4 hours by dropwise addition of a solution of 18.0 parts by weight of nitric acid ($d$= 1.5) in 65 parts by volume of ethylene chloride, whilst distilling off the water of reaction. The orange-yellow reaction product was filtered off at room temperature, washed with ethylene chloride and methanol and dried. (Melting point 340° C).

According to the invention, the dyestuffs according to the formulae 3, 4, 13, 14, 16, 19 and 21 have proved particularly suitable. In the described layer arrangement, the dyestuffs serve as activating sensitizers for the photoconductors in the transparent top layer. The dyestuffs have substituents with donor properties or also groupings with an electron attracting effect. Both functions together in a system of condensed benzene rings cause a particularly wide and long-wave absorption. By the presence of the dyestuffs as the dyestuff layer, it is achieved in the electrophotograhic recording material that highly light-sensitive organic photoconductor layers are obtained which may be arranged on a cylindrical drum or on an endless belt, for example.

In the photoconductive double layer arrangement, the dyestuffs have a very high photosensitivity in the visible range of the spectrum. Furthermore, they easily can be produced and purified. Moreover, they have good thermal and photochemical stabilities so that they can be vapor deposited in the vacuum without decomposition and also do not undergo photochemical changes under xerographic conditions, for example. The organic dyestuff layer must be extremely uniform since only its uniformity guarantees a uniform injection of charge carriers into the top layer.

To achieve this object, the dyestuff layers are applied according to special coating mehods. Such methods are the application by mechanically rubbing the most finely powdered dyestuff material into the electroconductive support material, the application by chemical deposition of a leucobase to be oxidized, for example, the application by electrolytical or electrochemical processes or the gun spray method. The application preferably is performed, however, by vapor depositing the dyestuff in the vacuum. A tightly packed coating is achieved thereby.

The tightly packed coating makes is unnecessary to produce thick dyestuff layers for achieving a high absorption. The tightly packed dyestuff molecules and the extremely low layer thickness permit, in a particularly advantageous manner, the transport of charge carriers so that it is completely sufficient to produce the charge carriers at the boundary layer only.

Excitation (1) and charge separation (2) take place in the dyestuff layer according to the following reaction equations:

$$S + h\nu \rightarrow S^x \qquad 1.$$

$$S^x + S \rightarrow S^+ + S^- \qquad 2.$$

with

S — dyestuff molecule $S^x$ — excited dyestuff molecule, and $S^+$; $S^-$ — dyestuff radical ions At the boundary surface between the organic dyestuff layer and the transparent top layer, reactions of the excited dyestuff molecules or the resulting charge carriers in the form of the dyestuff radical ions with the molecules of the of the charge transport effecting compound in the top layer are possible according to the following equation:

$$S^x + F_1 \rightarrow S^- + F_1^+ \qquad 3.$$

$$S^x + F_2 \rightarrow S^+ + F_2^- \qquad 4.$$

$$S^+ + F_1 \rightarrow S + F_1^+ \qquad 5.$$

$$S^- + F_2 \rightarrow S + F_2^- \qquad 6.$$

with $F_1$ — donor molecule $F_2$ — acceptor molecule $F_1^+$, $F_2^-$ — donor or acceptor radical ion At the boundary surface, sensitizing reactions take place between the transparent top layer and the organic dyestuff layer. The top layer thus is a sensitized organic photoconductor at least in the area of the boundary surface, which leads to the surprisingly high photoconductivity.

Reactions 3 and 5 proceed preferably when the $\pi$-electron system in the top layer is a compound which, as a donor compound, easily can release electrons. This is the case with 2,5-bis-(4-diethylaminophenyl)-oxidazole-1,3,4, for example. But also heterocyclic compounds with only one dialkyl amino group are suitable for rapid procedure of reactions 3 and 5. Reactions 4 and 6 are preferably possible with a substance in the top layer which, as an electron acceptor, easily accepts electrons, e.g. 2,4,7-trinitrofluorenone or 3,6-dinitro-N-t-butyl-naphthalimide.

By means of the specific embodiment of the invention it is sufficient for the efficiency of the dyestuff when, besides its intense absorption, it only has either electron-attracting substituents, e.g. $>C=O$, halogen, or electron-repelling substituents, e.g. alkyl or -O-alkyl, depending on whether it is preferably suitable for reactions 3, 5 or 4, 6.

The invention permits charge carrier transport fostered by a particularly low expenditure of energy within the tightly packed dyestuff layer according to the following reactions:

$$S^+ + S \rightarrow S + S^+ \quad 7.$$

or $$S + S^- \rightarrow S^- + S \quad 8.$$

In all conventional sensitizing processes, however, transport via the dyestuff molecules present in low concentration is impeded by their large distance from one another.

Analogous is the charge transport in the top layer with:

$$F_1^+ + F_1 \rightarrow F_1 + F_1^+ \text{ (p-conductive)} \quad 9.$$

$$F_2^- + F_2 \rightarrow F_2 + F_2^- \text{ (n-conductive)} \quad 10.$$

The practical consequence of reactions 1 to 10 is that, in the use of electron donors in the top layer, the double layer arrangement is negatively charged so that reactions 3, 5, 8, 9 can proceed. In the inverse case, layers with electron acceptors in the top layer are positively charged so that reactions 4, 6, 7 and 10 can proceed.

As mentioned before, the dyestuff layers are only very thin and the dyestuff thus is required in a small quantity only. But vapor deposition in the high vacuum assures an extremely high uniformity of the dyestuff layer, as it cannot easily be achieved according to a conventional coating method. This uniformity considerably contributes to the high sensitivity distinguishing the layers of the invention, the charge carrier reactions 3 and 4 proceeding without disturbing each other (recombination).

The transparent top layer has a high electric resistance and prevents in the dark the flowing off of the electrostatic charge. Upon exposure to light, it transports the charges produced in the organic dyestuff layer.

In the case of negative charge, the transparent top layer preferably consists of a mixture of an electron donor compound and a binder. But when the electrophotographic recording material is to be used for positive charge the transparent top layer consists of a mixture of an electron acceptor compound and a binder.

Consequently, in the transparent top layer there are used compounds for charge transport which are known as electron donors or electron acceptors. They are used together with binders or adhesives adapted to the compound for charge transport as regards charge transport, film property, adhesion, and surface characteristics. Furthermore, conventional sensitizers or substances forming charge transfer complexes are preferably additionally present. But they can only be used in so far as the necessary transparency of the top layer is not impaired. Finally, other usual additives such as levelling agents, plasticizers, and adhesives may also be present.

Suitable compounds for charge transport are especially those organic compounds which have an extended $\pi$-electron system, e.g. monomer aromatic heterocyclic compounds.

Monomers employed in accordance with the invention are those which have at least one substituted amino group or two alkoxy groups. Particularly proved have heterocyclic compounds, such as oxdiazole derivatives, which are mentioned in German Pat. No. 1,058,836. An example thereof is in particular the 2,6-bis-(p-diethylaminophenyl)-oxidazole-1,3,4,. Further suitable monomer electron donor compounds are, for example, triphenyl amine derivatives, carbocyclic aromatics, benzo-condensed heterocycles, pyrazoline or imidazole derivatives, as well as triazole and oxazole derivatives, as disclosed in German Pat. Nos. 1,060,260 and 1,120,875. also suitable are formaldehyde condensation products with various aromates, e.g. condensates from formaldehyde and 3-bromopyrene.

Besides these mentioned compounds having predominantly a p-conductive character, it is also possible to use n-conductive compounds. These so-called electron acceptors are known from German Pat. No. 1,127,218, for example. Compounds such as 2,4,7-trinitrofluorenone or N-t-butyl-3,6-dinitronaphthalimide have proved particularly suitable.

Suitable binders with regard to flexibility, film properties, and adhesion are natural and synthetic resins. Examples thereof are in particular polyester resins, e.g. those marketed under the names Dynapol (Dynamit Nobel), Vitel (Goodyear), and which are copolyesters of iso- and terephthalic acid with glycol. Silicone resins as those known under the name SR of General Electric Comp., USA, or Dow 804 of DOW Corning Comp., USA, and representing three-dimensionally cross-linked phenyl-methyl siloxanes have proved particularly suitable. Furthermore, copolymers of styrene and maleic acid anhydride, e.g. those known under the name Lytron, Monsanto Chemical Comp., USA, but also polycarbonate resins, e.g. those known under the name Lexan Grade of General Electric Comp., USA, or after-chlorinated polyvinyl chlorides such as Rhenoflex of Rheinpreussen AG, Germany, or chlorinated polypropylene such as Hostaflex of Farbwerke Hoechst AG, Germany, arc suitable for use.

The mixing ratio of charge transporting compound to binder may vary. Relatively certain limits are given, however, by the requirement for maximum photosensitivity, i.e. for the biggest possible portion of charge transporting compound, and for crystallization to be prevented, i.e. for the biggest possible portion of binder. A mixing ratio of about 1:1 parts by weight has proved preferable, but mixing ratios from about 3:1 to 1:4 or above, depending on the particular case, are also suitable.

The conventional sensitizers to be used additionally may advantageously foster charge transport. Moreover, they may produce charge carriers in the transparent top layers. Suitable sensitizers are, for example, Rhodamine B extra, Schultz, Farbstofftabellen (dyestuff tables), 1st volume, 7th edition, 1931, No. 864, page 365, Brilliant Green, No. 760, page 314,Crystal Violet, No. 785, page 329, Victoria Pure Blue, No. 822, page 347, Cryptocyanine, No. 927, page 397. In the same sense as act the sensitizers may also act added compounds which form charge transfer complexes with the charge transporting compound. Thus, it is possible to achieve another increase of the photosensitivity of the described double layers. The quantity of added sensitizer or of the compound forming the charge transfer complex is so determined that the resulting donor acceptor complex with its charge transfer band still is sufficiently transparent for light absorbed by the organic dyestuff layer beneath. Examples of such electron acceptors are 3,5- or 3,4-dinitro-benzoic acid, tetrachlorophthalic acid anhydride, 2,4,7-trinitrofluorenone, 3,6dinitronaphthalic acid anhydride, and N-substituted imides of the 3,6-dinitro-naphthalic acid. Optimum concentration is at a molar donor/acceptor ratio of about 10:1 and vice versa.

The addition of adhesives as binders to the charge transporting compounds already yields a good photosensitivity. In this case, low-molecular polyester resin, such as Adhesive 49,000, Du Pont, has proved particularly suitable.

In the described manner, the top layers have the property to render possible a high charge with a small dark discharge. Whereas in all conventional sensitizations an increase of the photosensitivity is connected with an increase of the dark current, the arrangement of the invention can prevent this parallelity. The layers are thus usable in electrophotographic copying devices with low copying speeds and very small lamp energies as well as in those with high copying speeds and correspondingly high lamp energies.

The invention will be further illustrated by way of the following examples, the values of which are summarized in the Table.

To manufacture photoconductive double layers, the dyestuffs listed below are vapor deposited by a vacuum pump (type A 1 of Pfeiffer, Wetzlar, Germany) at $10^{-3}$ to $10^{-4}$ mm Hg at the indicated temperatures, which were measured immediately at the substance to be evaporated, and over the indicated period of time onto a 90 $\mu$m thick aluminum foil mounted at a distance of approx. 15 cm. The dyestuff layers have a thickness in the range of about 0.05 to 1 $\mu$m, which was measured via the extinction. By vapor deposition onto a 75 $\mu$m thick, transparent polyester film and onto one vapor deposited with an aluminum layer, the following values are obtained for the dyestuff according to Formula 12 over the indicated period of vapor deposition:

| Vapor deposition time (min) | Measured extinction at 540 nm (E) | Layer thickness ($\mu$m) | $T_{1/2}$ (msec) | $U_o$ (V) |
|---|---|---|---|---|
| 2 | 0.38 | 0.15 | 54 | = 1,000 |
| 4 | 1.17 | 0.46 | 56 | = 680 |

The indicated layer thickness is calculated from the equation Layer thickness ($\mu$m) = $10E/\epsilon \cdot M \cdot d^{-1}$ if an extinction coefficient of $\epsilon \sim 1.0 \cdot 10^4$ and a density ($d$) of the dyestuff of 1 g/cm$^3$ are assumed (M = molecular weight).

The sensitivity of the dyestuff layer applied at the same time onto the aluminized polyester film was obtained after coating with a top layer (To) (as will be described later).

In order to test the electrophotographic properties, transparent top layers approx. 5–6 $\mu$m thick are applied to each dyestuff layer. For this, 1 part by weight of 2,4,7-trinitrofluorenone and 1 part by weight of polyester resin Dynapol L 206 of Dynamit Nobel, Troisdorf (TNF), or 1 part by weight of 2,5-bis-(4-diethylaminophenyl)-oxidazole-1,3,4 and 1 part by weight of a copolymer of styrene and maleic anhydride, Lytron 820 of Monsanto Corp., USA (To), are applied by whirler-coating as a 20% solution in tetrahydrofurane, in part, as indicated, with the addition of sensitizer in the indicated concentration relative to the solids content, and thereafter the coating is dried for 2 to 3 minutes at 110°–120° C in a drying cabinet.

For comparison of the photosensitiity, identical top layers are produced analogously zero layer) on an aluminum foil, and these show that according to the invention increases in the photosensitivity by a factor of more than 200 are achievable.

In order to measure the photosensitivity, the particular photoconductor layer is charged to a positive or negative potential for which it is passed three times through a charging instrument, for example Kalle type AG 56, setting 7.5 kV. The layer is then exposed to an XBO 150 xenon lamp of Osram. The light intensity in the plane of measurement is approx. 300 lx in the experiments of serial numbers 0, 1, 9, 11, 13, 16 to 22, 25, 31, 33, 35, 37 and 39, 437 $\mu$W. cm$^{-2}$ in the experiment under numbers 6, 7, 8, 29 and 30 and 487 $\mu$W.Cm$^{-2}$ in the case of the remaining examples. The charge level (V) and the photo-induced light decay curve of the photoconductor layer was measured by means of a 610 B electrometer of Messrs. Keithley Instruments, USA, through a probe in accordance with the method described by Arneth and Lorenz in "Reprographie", 3, 199 (1963). The photoconductor layer is characterized by the charge level (V) and by the time ($T_{1/2}$) after which half the charge, V/2, is reached.

As indicated, the sensitivity factor f was in part additionally indicated with a Dyn Test-90 instrument of Messrs. ECE, Giessen, Germany, for measurement of the sensitivity. This factor is calculated from the formula $$f = \frac{U_o}{U_h + \Delta U_D}$$

with $U_o$ as the initial potential, $U_h$ as the potential after 2 seconds ' exposure and $\Delta U_D$ as the dark decay after 2 seconds.

This factor indicates by how much the initial potential $U_o$ at the layer is greater than the potential $U_h$ achievable after 2 seconds' exposure with a tungsten lamp, whilst eliminating the dark discharge.

The abbreviations used for the sensitizers employed denote the following:

RhB Rhodamine B extra

BG Brilliant Green

Table

| Serial No. | Dyestuff of FIG. No. | Vapor deposition min/° C | Top Layer | Additive % | $T_{1/2}$ (msec) | Photo-sensitivity V | f |
|---|---|---|---|---|---|---|---|
| 0 | — | — | To | — | 2,100 | −420 | 1.0 |
| 0 | — | — | TNF | — | 11,000 | +500 | 1.0 |
| 1 | 3 | 1/210 | To | — | 26 | =625 | 1.26 |
| 2 | 3 | 1/210 | To | 0.3 RhB | 20 | −550 | 2.02 |
| 3 | 4 | 1/200 | To | — | 28 | −660 | 1.34 |
| 4 | 4 | 1/200 | To | 0.3 RhB | 18 | −520 | 1.93 |
| 5 | 4 | 1/200 | TNF | — | 39 | +600 | |
| 6 | 6 | 4/210 | To | 0.3 RhB | 60 | −510 | |
| 7 | 7 | 4/190 | To | 0.3 RhB | 65 | −440 | |
| 8 | 10 | 2/220 | To | 0.3 RhB | 90 | −540 | |
| 9 | 12 | 2/320 | To | — | 135 | −600 | |
| 10 | 12 | 2/320 | To | 0.3 RhB | 45 | −500 | 1.73 |
| 11 | 13 | 1.5/210 | To | — | 26 | −600 | 1.46 |
| 12 | 13 | 1.5/210 | To | 0.3 RhB | 20 | −500 | 2.1 |
| 13 | 14 | 2/280 | To | — | 21 | −560 | 1.82 |
| 14 | 14 | 2/280 | To | 0.3 RhB | 16 | −560 | 2.46 |
| 15 | 14 | 2/280 | To | 0.05 BG | 19 | −560 | 1.82 |
| 16 | 16 | | To | — | 200 | −1,150 | |
| 17 | 16 | | To | 0.3 RhB | 35 | −1,060 | 1.4 |
| 18 | 16 | | To | 0.05 BG | 40 | −1,000 | 1.4 |
| 19 | 16 | | TNF | — | 1,300 | +940 | |
| 20 | 17 | 2/330 | To | — | 520 | −950 | |
| 21 | 18 | | To | — | 740 | −1,150 | |
| 22 | 19 | 3/320 | To | — | 25 | −600 | 1.61 |
| 23 | 19 | 3/320 | To | 0.3 RhB | 23 | −530 | 1.81 |
| 24 | 19 | 3/320 | TNF | — | 78 | +625 | |
| 25 | 21 | 2/310 | To | — | 27 | −605 | 1.31 |
| 26 | 21 | 2/310 | To | 0.3 RhB | 19 | −580 | 2.12 |
| 27 | 21 | 2/310 | To | 0.05 BG | 24 | −550 | 1.51 |
| 28 | 21 | 2/310 | TNF | — | 31 | +530 | |
| 29 | 22 | 4/200 | To | 0.3 RhB | 85 | −370 | |
| 30 | 23 | 4/210 | To | — | 29 | −580 | |
| 31 | 25 | 4/370 | To | — | 26 | −550 | 1.4 |
| 32 | 25 | 4/370 | To | 0.3 RhB | 23 | −530 | 1.97 |
| 33 | 27 | 0.5/120 | To | — | 305 | −540 | |
| 34 | 27 | 0.5/120 | To | 0.3 RhB | 49 | −500 | 1.72 |
| 35 | 28 | 1.5/180 | To | — | 300 | −560 | |
| 36 | 28 | 1.5/180 | To | 0.3 RhB | 39 | −570 | 1.48 |
| 37 | 29 | 1.5/250 | To | — | 55 | −580 | 1.15 |
| 38 | 29 | 1.5/250 | To | 0.3 RhB | 26 | −460 | 2.08 |
| 39 | 30 | 1/180 | To | — | 40 | −580 | 1.25 |
| 40 | 30 | 1/180 | To | 0.3 RhB | 35 | −370 | 1.63 |

It will be obvious to those skilled in the art that many modifications may be made within the scope of the present invention without departing from the spirit thereof, and the invention includes all such modifications.

What is claimed is:

1. In an electrophotographic recording material consisting of an electroconductive support material with a photoconductive double layer of organic materials which consists of a tightly packed, homogeneous, uniform, opaque, charge carrier producing dyestuff layer prepared by vacuum-evaporation of the dyestuff and of a transparent top layer of insulating materials with at least one charge transporting compound, the improvement in which the organic dyestuff layer consists of a compound of the general formulae

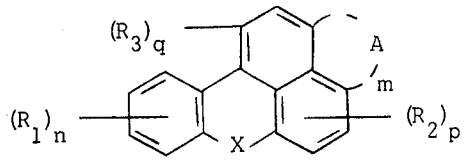

(I)

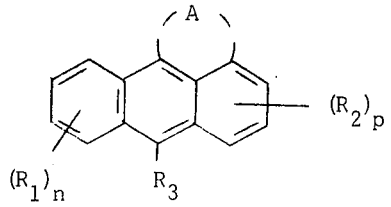

(II)

in which

X is —O— or —S— or —CO—, and

A is —CO—B—CO—, with

B being —O— or —NR—, in which

R is hydrogen, $C_1$–$C_4$ alkyl, $C_3C_8$ alkoxyalkyl, optionally substituted aryl or an N-heterocyclic radical, and $R_1$, $R_2$, and $R_3$ are identical or different and stand for hydrogen, $C_1$–$C_4$ alkyl, $C_1$–$C_4$ alkoxy, amino or nitro groups or halogen and, in the case of Formula I, $R_3$ also may stand for a benzene ring system, fused between $R_3$ and A, and in which

*m* is o or 1, and

*n*, *p*, and *q* are integers between 1 and 4, and $n+p+q \leqslant 10$, and in which the transparent top layer consists of a mixture of a charge transporting, monomeric, heterocyclic compound selected from the group consisting of oxazoles, oxidazoles, triazoles, imidazoles and pyrazoles with at least one substituted amino group or two alkoxy groups and having an extended $\pi$-electron system, and a binder selected from the group of polyester, copolyester, silicone resin, copolymer of styrene with maleic anhydride and polycarbonate resin, the mixture of the charge transporting compound and the binder being in a ratio by weight of about 1:1, the transparent top layer having a thickness of about 5 to about 20 microns and the dyestuff layer having a thickness of about 0.005 to about 2 microns, which recording material is useful in an electrophotographic copying process with negative charging of the top layer if an electron-donating compound is used.

2. A recording material according to claim 1, in which the aryl radical is substituted by $C_1$–$C_4$-alkyl, $C_1$–$C_4$-alkoxy, nitro groups or halogen.

3. A recording material according to claim 1, in which the organic dyestuff layer consists of benzoxanthene-3,4-dicarboxylic acid anhydride.

4. A recording material according to claim 1, in which the organic dyestuff layer consists of 10-methoxybenzoxanthene-3,4-dicarboxylic acid anhydride.

5. A recording material according to claim 1, in which the organic dyestuff layer consists of benzothioxanthene-3,4-dicarboxylic acid anhydride.

6. A recording material according to claim 1, in which the organic dyestuff layer consists of 1,6-dinitrobenzothioxanthene-3,4-dicarboxylic acid anhydride.

7. A recording material according to claim 1, in which the organic dyestuff layer consists of benzothioxanthene-3,4-dicarboxylic acid-N-(3-methoxy-n-propyl)-imide.

8. A recording material according to claim 1, in which the organic dyestuff layer consists of benzothioxanthene-3,4-dicarboxylic acid-N-mesityl-imide.

9. A recording material according to claim 1, in which the organic dyestuff layer consists of benzothioxanthene-3,4-dicarboxylic acid-N-(3-nitrophenyl)imide.

10. A material according to claim 1, in which the heterocyclic compound is an oxadiazole.

11. A material according to claim 1, in which the heterocyclic compound is 2,5-bis-(4-diethylaminophenyl)-oxadiazole-1,3,4.

12. A material according to claim 1 in which the binder is a copolymer from styrene and maleic acid anhydride.

13. A material according to claim 1 in which the transparent top layer additionally contains sensitizers.

* * * * *